US010699839B2

(12) United States Patent
Yoon et al.

(10) Patent No.: US 10,699,839 B2
(45) Date of Patent: Jun. 30, 2020

(54) THIN FILM-TYPE INDUCTOR

(71) Applicant: SAMSUNG ELECTRO-MECHANICS CO., LTD., Suwon-si, Gyeonggi-do (KR)

(72) Inventors: Chan Yoon, Suwon-si (KR); Won Chul Sim, Suwon-si (KR); Dong Hwan Lee, Suwon-si (KR); Young Ghyu Ahn, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 206 days.

(21) Appl. No.: 15/818,440

(22) Filed: Nov. 20, 2017

(65) Prior Publication Data

US 2019/0013141 A1 Jan. 10, 2019

(30) Foreign Application Priority Data

Jul. 5, 2017 (KR) ..... 10-2017-0085286

(51) Int. Cl.
*H01F 5/00* (2006.01)
*H01F 27/28* (2006.01)
(Continued)

(52) U.S. Cl.
CPC ..... *H01F 27/2804* (2013.01); *H01F 17/0006* (2013.01); *H01F 27/292* (2013.01);
(Continued)

(58) Field of Classification Search
CPC .. H01F 27/2804; H01F 27/292; H01F 27/255; H01F 27/323; H01F 2027/2809;
(Continued)

(56) References Cited

U.S. PATENT DOCUMENTS 6,218,925 B1 * 4/2001 Iwao ..... H01F 17/0013 336/200
9,711,273 B2 * 7/2017 Suzuki ..... H01F 27/29
(Continued)

FOREIGN PATENT DOCUMENTS

JP 11-204337 A 7/1999
JP 2014-080674 A 5/2014
(Continued)

OTHER PUBLICATIONS

Office Action issued in corresponding Korean Patent Applicatin No. 10-2017-0085286, dated Jul. 12, 2018.
(Continued)

*Primary Examiner* — Mang Tin Bik Lian
(74) *Attorney, Agent, or Firm* — Morgan, Lewis & Bockius LLP

(57) ABSTRACT

A thin film-type inductor includes a body having a coil, and a first external electrode and a second external electrode. The first and second external electrodes are each disposed on an external surface of the body. The coil includes a coil body and a via portion. The via portion is directly connected to the first external electrode. The coil body includes a base conductor layer in a lower portion and a plating layer in an upper portion.

15 Claims, 2 Drawing Sheets

(51) Int. Cl.
*H01F 27/29* (2006.01)
*H01F 17/00* (2006.01)
*H01F 27/255* (2006.01)
*H01F 17/04* (2006.01)

(52) U.S. Cl.
CPC ..... *H01F 27/255* (2013.01); *H01F 2017/002* (2013.01); *H01F 2017/0073* (2013.01); *H01F 2017/048* (2013.01); *H01F 2027/2809* (2013.01)

(58) Field of Classification Search
CPC ..... H01F 17/0006; H01F 2017/0073; H01F 2017/002
USPC ..... 336/200, 192, 223, 233, 232
See application file for complete search history.

(56) References Cited

U.S. PATENT DOCUMENTS 9,824,804 B2 * 11/2017 Choto ..... H01F 1/344
2008/0130258 A1 * 6/2008 Kudo ..... H01F 27/027 361/811
2012/0062348 A1 * 3/2012 Hashimoto ..... H01F 17/0013 336/192
2012/0274432 A1 * 11/2012 Jeong ..... H01F 27/2804 336/192
2013/0249664 A1 * 9/2013 Tonoyama ..... H01F 41/04 336/200
2014/0085038 A1 * 3/2014 Iwasaki ..... H01F 17/0013 336/221
2014/0333404 A1 11/2014 Bae et al.
2015/0035634 A1 * 2/2015 Nakamura ..... H01F 17/0013 336/170
2015/0035640 A1 * 2/2015 Wang ..... H01F 17/0006 336/200
2015/0340149 A1 11/2015 Lee et al.
2016/0012956 A1 * 1/2016 Yang ..... H01F 41/32 336/200
2016/0217907 A1 7/2016 Jeong
2017/0256353 A1 9/2017 Park et al.

FOREIGN PATENT DOCUMENTS

JP 2014-216370 A 11/2014
JP 2015-220452 A 12/2015
JP 2017-103355 A 6/2017
KR 10-2012-0122589 A 11/2012
KR 10-2015-0009391 A 1/2015
KR 10-2016-0031391 A 3/2016
KR 10-2016-0092779 A 8/2016
WO 2016/039518 A1 3/2016

OTHER PUBLICATIONS

Office Action issued in corresponding Japanese Patent Applicatin No. 2017-225002, dated Aug. 14, 2018.

* cited by examiner

THIN FILM-TYPE INDUCTOR

CROSS-REFERENCE TO RELATED APPLICATION

This application claims the benefit of priority to Korean Patent Application No. 10-2017-0085286, filed on Jul. 5, 2017 in the Korean Intellectual Property Office, the disclosure of which is incorporated herein by reference in its entirety.

TECHNICAL FIELD

The present disclosure relates to a thin film-type inductor, and more particularly to a high capacity power inductor.

BACKGROUND

An inductor is a passive device for removing noise by forming an electronic circuit, together with a resistor and a capacitor. An inductor is used for a resonance circuit and a filter circuit for amplifying a signal within a given frequency band in combination with a capacitor using electromagnetic characteristics.

Recently, with the evolution of electronic products, especially smartphones, there has been an increase in demand for thin power inductors to withstand high current, have high efficiency, high performance, and a small size, and demand for low profile power inductors having a 1005 size, (width× length 1.0 mm×0.5 mm) and 0.5T (thickness 0.5 mm), is gradually increasing.

A method of manufacturing a thin film-type power inductor is divided into a substrate process and a post process. First, a dry film is exposed and developed on a copper clad laminate (CCL) substrate having a thickness of about 60 μm, and then a plating process is performed. Thereafter, a through-hole is formed in an interior of a coil through laser processing, and an insulating material is applied to the coil. Thereafter, the substrate structure is pressed, stacked and filled using a sheet-shaped metal-resin composite. Then, a completed chip is manufactured through dicing, grinding, and external electrode forming processes. In the case of a thin film-type power inductor, because coils are formed on the upper surface and the lower surface of the substrate, considerable thickness is required due to thickness of the upper coil and the lower coil. Thus, there are limitations to implementing a thin film-type inductor having a low profile.

SUMMARY

An aspect of the present disclosure provides a miniaturized power inductor, particularly, a thin film-type inductor having a low profile by significantly reducing a thickness of a chip.

According to an aspect of the present disclosure, a thin film-type inductor includes: a body including a magnetic material embedding a coil, a first external electrode and a second external electrode. The first and second external electrodes are each disposed on an external surface of the body. The coil includes a coil body and a via portion. The via portion is directly connected to the first external electrode. The coil body includes a base conductor layer in a lower portion and a plating layer in an upper portion.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
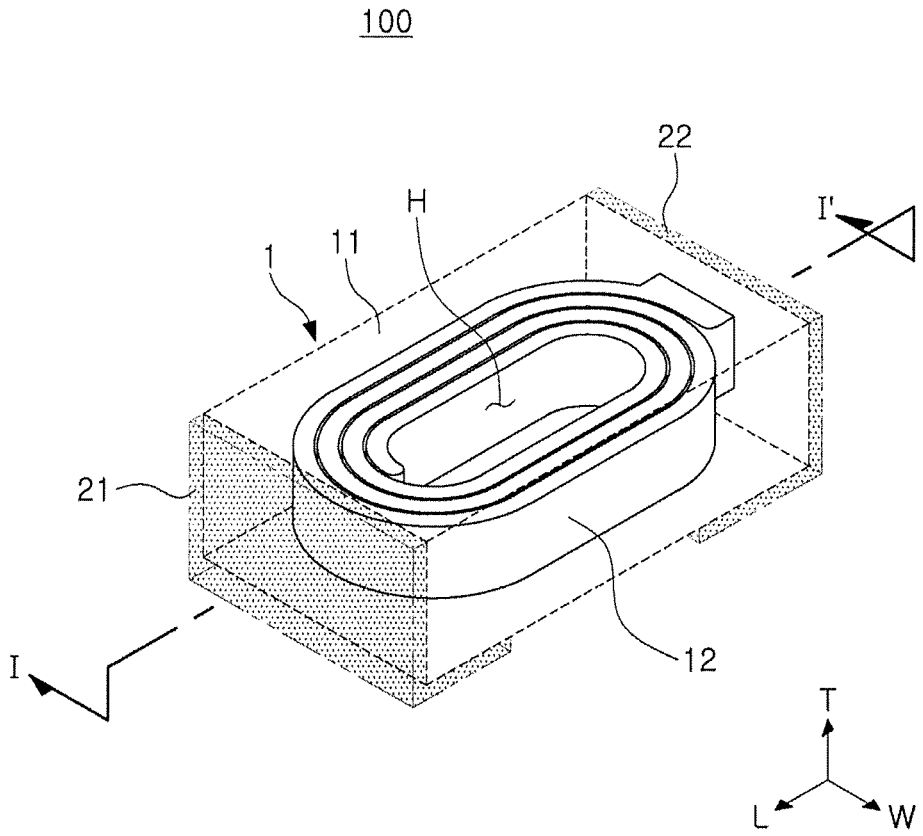
FIG. 1 is a schematic perspective view of a thin film-type inductor according to an embodiment.

Hereinafter, embodiments of the present disclosure will be described as follows with reference to the accompanying drawings. In the accompanying drawings, shapes, sizes and the like, of the components may be exaggerated or shortened for clarity.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being 'on,' 'connected to,' or 'coupled to' another element, it can be directly 'on,' 'connected to,' or 'coupled to' the other element or other elements intervening therebetween may be present. In contrast, when an element is referred to as being 'directly on,' 'directly connected to,' or 'directly coupled to' another element, there may be no other elements or layers intervening therebetween. Like numerals refer to like elements throughout. As used herein, the term 'and/or' includes any and all combinations of one or more of the associated listed items.

It will be apparent that although the terms first, second, third, etc. may be used herein to describe various members, components, regions, layers and/or sections, any such members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the embodiments.

Spatially relative terms, such as 'above,' 'upper,' 'below,' and 'lower' and the like, may be used herein for ease of description to describe one element's relationship relative to another element(s) as shown in the figures. It will be understood that spatially relative terms are intended to encompass different orientations of the device in use or operation, in addition to the orientation depicted in the figures. For example, if the device in the figures is turned over, elements described as 'above,' or 'upper' relative to other elements would then be oriented 'below,' or 'lower' relative to the other elements or features. Thus, the term 'above' can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms 'a,' 'an,' and 'the' are intended to include the plural forms as well, unless the context clearly indicates otherwise. It will be further understood that the terms 'comprises,' and/or 'comprising' when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted alone, in combination or in partial combination.

The contents of the present disclosure described below may have a variety of configurations and propose only a required configuration herein, but are not limited thereto.

Hereinafter, a thin film-type inductor according to an embodiment will be described, but embodiments are not limited thereto.

Figure 2:
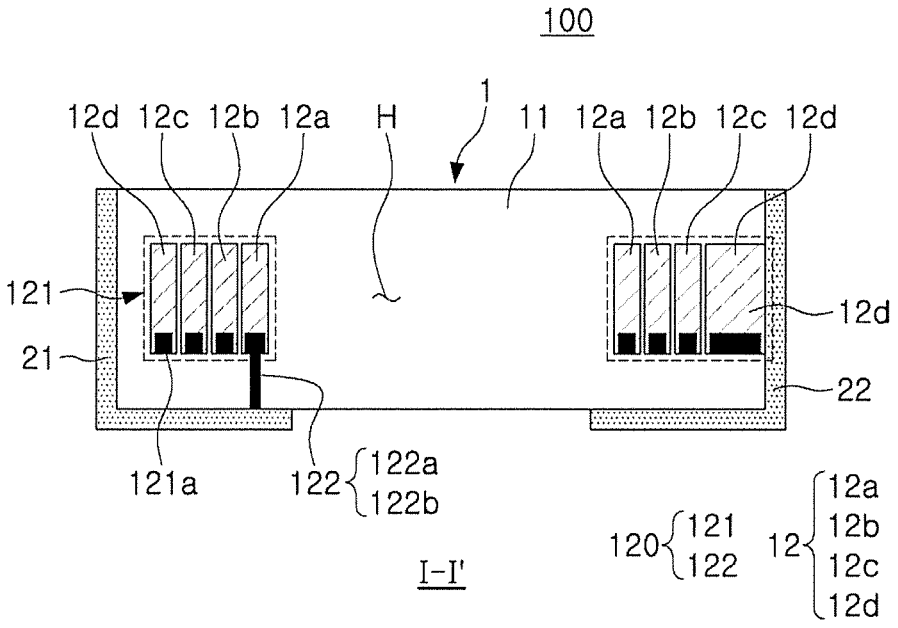
FIG. 2 is a schematic cross-sectional view taken along line I-I' of the thin film-type inductor of FIG. 1.

FIG. 1 is a schematic perspective view of a thin film-type inductor according to an embodiment, and FIG. 2 is a cross-sectional view taken along line I-I' of FIG. 1.

Referring to FIGS. 1 and 2, a thin film-type inductor 100 includes a body 1 as well as a first external electrode 21 and a second external electrode 22 disposed on an external surface of the body to be spaced apart from each other.

The body 1 forms an outer cover of the thin film-type inductor provided in the form of a chip. The body 1 further includes an upper surface and a lower surface opposing each other in a thickness (T) direction, a first end surface and a second end surface opposing each other in a length (L) direction, and a first side surface and a second side surface opposing each other in a width (W) direction. The various surfaces of the body provide the body a substantially hexahedral shape, but embodiments are not limited thereto.

The body 1 further includes a magnetic material 11. For example, the body may be filled with a ferrite or metal-based soft magnetic material. In an embodiment, the ferrite includes a known ferrite material such as Mn—Zn based ferrite, Ni—Zn based ferrite, Ni—Zn—Cu based ferrite, Mn—Mg based ferrite, Ba based ferrite or Li based ferrite, or the like. The metal-based soft magnetic material may be an alloy containing one or more selected from the group consisting of iron (Fe), silicon (Si), chrome (Cr), aluminum (Al), and nickel (Ni). For example, the metal-based soft magnetic material may include a Fe—Si—B—Cr based amorphous metal particle, but embodiments are not limited thereto. An average particle size of the metal-based soft magnetic material may be 0.1 μm or more and 20 μm or less, an the metal-based soft magnetic material may be included while being dispersed in a polymer such as an epoxy resin, polyimide, or the like.

A coil 12 embedded by a magnetic material is included in the body 1. The coil 12 includes a coil body 121 and a via portion 122 extended from the coil body.

The coil body 121 is a component of the coil 12 included in a thin film-type inductor. The coil body 121 may be formed of a base conductor layer 121*a* functioning as a seed pattern, and a plating layer formed on the base conductor layer. The plating layer may be formed using one or more of anisotropic plating and isotropic plating, as the base conductor layer is used as a seed. In FIG. 2, the plating layer 121*b* is illustrated as a plating layer formed using anisotropic plating by way of example, but embodiments are not limited thereto. Depending on the needs of a person skilled in the art and the manufacturing conditions, after isotropic plating is performed first, anisotropic plating may be performed. Alternatively, anisotropic plating may be performed two times or more. As described above, the order and the method of implementing a plating layer are not particularly limited. The plating layer 121*b* may be formed by including a metal having excellent electrical conductivity, and may be formed of, for example, silver (Ag), palladium (Pd), Al, nickel (Ni), titanium (Ti), gold (Au), copper (Cu), platinum (Pt), alloys thereof, or the like. A specific method of forming a plating layer is not particularly limited. For example, the plating layer may be formed using electrolytic plating.

Next, the base conductor layer 121*a* is provided by including a metal having excellent electrical conductivity. The base conductor layer may be formed using electrolytic plating, electroless plating, sputtering, or the like. The base conductor layer 121*a* is formed on a support member (not shown) to be removed during a manufacturing method, so a lower surface of the base conductor layer 121*a* is flat to a degree substantially equal to that of flatness of an upper surface of the support member.

The coil 12 includes a plurality of coil patterns 12*a*, 12*b*, 12*c*, 12*d*, . . . . The plurality of coil patterns 12*a*, 12*b*, 12*c*, 12*d*, etc. are connected to each other, so the entirety of the coil 12 has the form of a spiral coil. In this case, an innermost coil pattern 12*a* closest to a through-hole H is connected to the via portion 122 to allow the coil 12 to connect to an external electrode (21 or 22 as the case may be). The via portion 122 is preferably formed at the same time as the base conductor layer 121*a* of a coil 12 during a manufacturing process, so a material forming the via portion 122 is substantially the same as a material forming the base conductor layer 121*a* of the coil 12. In addition, the base conductor layer 121*a* of the innermost coil pattern 12*a* and the via portion 122 are continuously formed without a distinct interface.

The via portion 122 is disposed to be substantially perpendicular to a lower surface of the body 1. On the lower surface of the body 1, the first external electrode 21 and the second external electrode 22 are disposed to be spaced apart from each other. In the embodiment illustrated in FIG. 2, the via portion 122 is directly connected to the first external electrode 21, however, embodiments are not particularly limited as such. As illustrated in the drawing, a shape of a cross section of the via portion may be rectangular, or may be a tapered shape in which a width is narrowed in a downward direction, or a reverse tapered shape in which a width is narrowed in an upward direction.

In addition, the via portion 122 is substantially formed of at least one via hole 122*a* and a via electrode 122*b* filling the via hole. A cross section of the via portion 122 may be determined depending on a shape of a cross section of the via hole 122*a*. In an embodiment, the via portion 122 includes a plurality of via holes and a via electrode filling the same, so degradations in reliability caused by a via short when the coil and the external electrode are connected to each other may be reduced.

Typically, a via portion is formed by first forming a via hole passing through a support member is formed and then filling an interior of the via hole with a conductive material. Thus, a support member is generally disposed on the same plane as the via portion.

According to an embodiment of the present disclosure, the plane of the via portion 122 is filled with the magnetic material 11. Referring to FIG. 2, the vicinity of the via portion 122 of the thin film-type inductor 100 is filled with the magnetic material 11, so a magnetic material may further fill a volume equal to that otherwise occupied by the support member. As a result, it is advantageous to implement high inductance in a thin film-type inductor.

Unlike the first external electrode 21, which is directly connected to a coil through the via portion 122 of the coil 12, the second external electrode 22 is directly connected to the coil 12 through the coil body 121 of the coil 12. An outermost coil pattern 12*d* in the coil 12 is directly connected to the second external electrode 22. The outermost coil pattern 12*d* disposed close to the second external electrode 22 may function as a lead-out portion of the coil 12. Here, the lead-out portion of the coil is a component allowing a coil body to be exposed to an external surface of the body to be electrically connected to an external electrode.

In FIG. 2, among a plurality of coil patterns 12*a*, 12*b*, 12*c*, 12*d* . . . disposed toward a first end surface with the through-hole H as the center and a plurality of coil patterns 12*a*, 12*b*, 12*c*, 12*d* . . . disposed toward a second end surface, widths (w) of respective coil patterns except for a lead-out portion are illustrated to be substantially the same. However, those skilled in the art may differentiate a width and a thickness of the plurality of coil patterns in consideration of manufacturing conditions and required characteristic values. For example, a width of each of a plurality of coil patterns disposed toward the first end surface with the through-hole as the center may be narrower than a width of each of a plurality of coil patterns disposed toward the second end surface (not shown).

The first external electrode 21 and the second external electrode 22 may each have an L-shape as a whole. Such a structure is derived by considering that at least a portion of the first external electrode 21 should be disposed in a lower surface of the body 1 and at least a portion of the second external electrode 22 should be disposed in the second end surface of the body 1, as the first external electrode 21 is connected to the coil 12 through a via portion 122 exposed to the lower surface of the body 1 and the second external electrode 22 is connected to the coil 12 through a lead-out portion exposed to the second end surface of the body 1. In order for the first external electrode 21 and the second external electrode 22 to be symmetrically provided on the external surface of the body 1, the first external electrode 21 and the second external electrode 22 are extended from at least a portion of the lower surface of the body 1 to at least a portion of the first end surface of the body 1 and at least a portion of the second end surface, respectively. However, a shape of an external electrode is not limited to an L-shape. For example, one or both the external electrodes may have a C-shape. Alternatively, while the first external electrode may only disposed in a lower surface, the second external electrode may only disposed in the second end surface.

Figure 3:
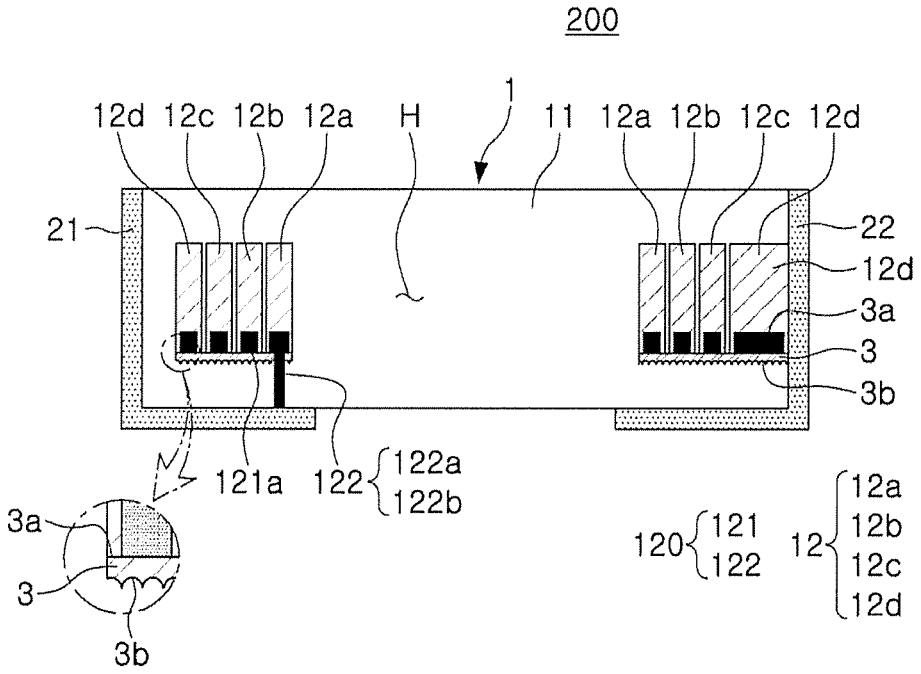
FIG. 3 is a schematic cross-sectional view of a modification of FIG. 2.

FIG. 3 is a schematic cross-sectional view of a thin film-type inductor 200 according to a modification of the thin film-type inductor 100 of FIGS. 1 and 2. For convenience of description, the overlapping description of the thin film-type inductor of FIGS. 1 and 2 will be omitted, and the same reference numerals are used for the overlapped configurations.

Referring to FIG. 3, an insulating material 3 is disposed in a lower surface of the coil 12, that is, at least a portion of the same plane as the via portion 122. The insulating material 3 remains, as a support member is not completely removed in a process of removing the support member, after a coil is formed during one operation of a manufacturing process. The insulating material 3, as illustrated in FIG. 3, may be continuously provided in a lower surface of a coil, or may be discontinuously provided in a portion of the lower surface of the coil.

Regardless of whether the insulating material 3 is provided continuously or discontinuously, a maximum thickness of the insulating material 3 is about 30 μm or less. A thickness of the insulating material exceeding 30 μm may limit implementation of a high aspect ratio (AR) and high capacity of a coil.

The insulating material 3 is a region remaining after a process of removing a support member, so surface roughness (hereinafter referred to as Ra_upper) of an upper surface 3*a* and surface roughness (hereinafter referred to as Ra_lower) of a lower surface 3*b* of the insulating material 3 may be different from each other. Ra_lower may be relatively high, compared to Ra_upper, due to an uneven portion formed during a laser or wet etching. As Ra_upper is lower than Ra_lower, the upper surface may be provided as a flat surface. As Ra_lower relatively high, when a magnetic material fills, further stable embedding between the magnetic material 11 and a coil 12 may be possible.

The thin film-type inductor 100 illustrated in FIGS. 1 and 2 and the thin film-type inductor 200 illustrated in FIG. 3 may be formed of a chip component. and thicknesses T1 and T2 of an overall chip component are about 200 μm to about 300 μm, which means a thin film-type inductor in a low profile, in which a thickness of an overall chip component is significantly reduced. As a substantial portion of a substrate occupying about 60 μm is removed, a removed free space is further filled with a magnetic material, and a thickness of a coil is further secured, so a structure described above may be provided.

Figure 4:
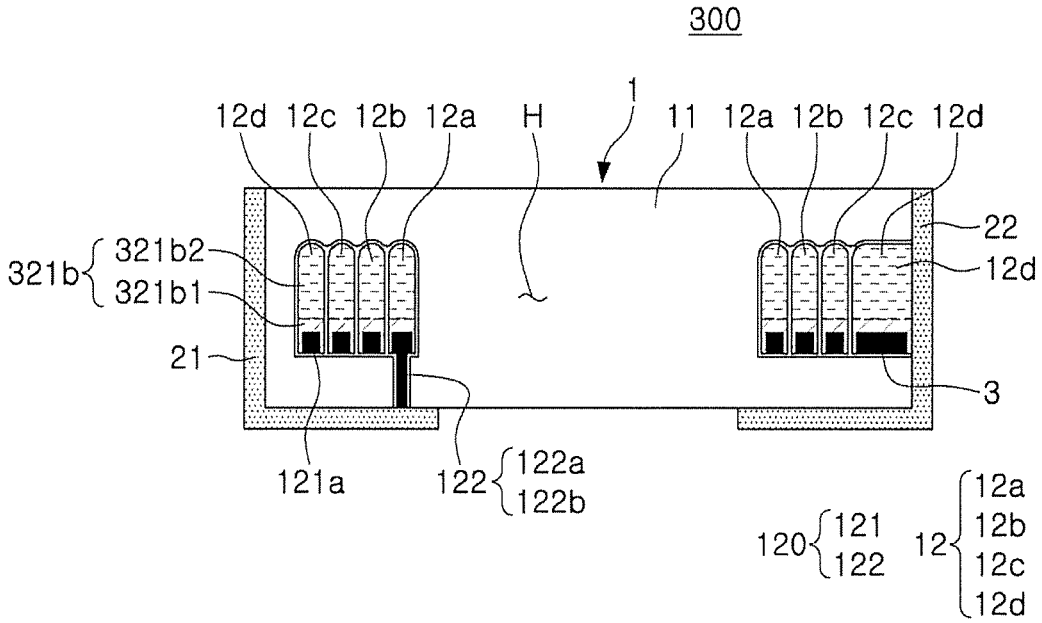
FIG. 4 is a schematic cross-sectional view of another modification of FIG. 2.

FIG. 4 is a schematic cross-sectional view of a thin film-type inductor 300 in which a shape of a plating layer is different from that of the thin film-type inductor of FIGS. 1 and 2. For convenience of description, the overlapping description of the thin film-type inductor of FIGS. 1 and 2 will be omitted, and the same reference numerals are used for the overlapped configurations.

Referring to FIG. 4, an upper surface of a plating layer 321*b* of coil 12 is configured in a curved shape, which may be provided by appropriately selecting a plating rate and a type of a plating solution, when the plating layer is formed. The plating layer 321*b* of the coil 12 is disposed on an upper surface of the base conductor layer 121*a*. In detail, the plating layer is formed of an isotropic plating layer 321*b*1 and an anisotropic plating layer 321*b*2 provided above the isotropic plating layer 321*b*1. In this case, an additional insulating material 3 may be disposed to allow a plating layer of the coil to be insulated from the magnetic material 11. The insulating material 3 is provided to have a predetermined thickness in a shape of a surface of the plating layer. A specific thickness is not particularly limited as long as the thickness allows a coil to be insulated from a magnetic material. In an embodiment, the thickness is about 10 μm or less, considering an overall thickness of a chip, or the like.

In the thin film-type inductors 100, 200, and 300 described above, due to a structure in which one end of a coil, that is, a via portion is connected to a first external electrode of a lower surface of a body, and the other end, that is, a lead-out portion is connected to a second external electrode of a second end surface of the body, a thickness of a chip may be significantly reduced, while high capacity and high current characteristics may be satisfied.

As set forth above, according to an embodiment, a power inductor with 0.2 T (a thickness of 0.2 mm) may be provided by significantly reducing a thickness of a chip.

While embodiments have been shown and described above, it will be apparent to those skilled in the art that modifications and variations could be made without departing from the scope of the present disclosure as defined by the appended claims.

What is claimed is:

1. A thin film-type inductor, comprising:

a body including a magnetic material embedding a coil; and a first external electrode and a second external electrode, each disposed on an external surface of the body, wherein the coil comprises a coil body and a via portion, the via portion is directly connected to the first external electrode, and the coil body comprises a base conductor layer in a lower portion and a plating layer in an upper portion, wherein the via portion is directly connected to the base conductor layer and the first external electrode, and wherein the coil body includes a plurality of coil patterns, and an innermost coil pattern is directly connected to the via portion through the base conductor layer.

2. The thin film-type inductor of claim 1, wherein the body has an upper surface and a lower surface opposing the upper surface in a direction in which the via portion is extended, and the first external electrode and the second external electrode are disposed to be spaced apart from each other in the lower surface.

3. The thin film-type inductor of claim 2, wherein the first external electrode and the second external electrode extend from the lower surface of the body to a corresponding end surface of the body adjacent to the lower surface.

4. The thin film-type inductor of claim 1, wherein the coil is surrounded by an insulating layer, and the insulating layer insulates the coil from the magnetic material.

5. The thin film-type inductor of claim 1, wherein the via portion includes at least one via hole and a via electrode filling the at least one via hole.

6. The thin film-type inductor of claim 1, wherein at least a portion of a lower portion of the coil body is provided with an insulating material.

7. The thin film-type inductor of claim 6, wherein a thickness of the insulating material is 30 μm or less.

8. The thin film-type inductor of claim 6, wherein, in the insulating material, surface roughness (Ra_lower) of a lower surface of the insulating material, opposing the first external electrode and the second external electrode, is greater than surface roughness (Ra_upper) of an upper surface of the insulating material opposing the lower surface.

9. The thin film-type inductor of claim 1, wherein the coil body includes a plurality of coil patterns, and an outermost coil pattern is directly connected to the second external electrode through a lead-out portion of the coil.

10. The thin film-type inductor of claim 9, wherein the lead-out portion is exposed to the external surface of the body at right angle to the via portion.

11. The thin film-type inductor of claim 1, wherein the plating layer comprises an anisotropic plating layer.

12. The thin film-type inductor of claim 1, wherein a direction of growth of the plating layer is the same as a direction in which the via portion is extended.

13. The thin film-type inductor of claim 1, wherein the first external electrode and the second external electrode are an L-shaped electrode.

14. The thin film-type inductor of claim 1, wherein an upper surface of the coil has a curved shape, convex upwardly.

15. The thin film-type inductor of claim 1, wherein the thin film-type inductor comprises a chip having a total thickness of 200 μm or more and 300 μm or less.

* * * * *